US008418854B2

(12) United States Patent
Zimmermann et al.

(10) Patent No.: US 8,418,854 B2
(45) Date of Patent: Apr. 16, 2013

(54) TRAY AND HOOD PACKAGE

(75) Inventors: Joerg Zimmermann, Eppstein-Brehmthal (DE); Ibrahim Ulas, Steinbach am Taunus (DE)

(73) Assignee: The Procter and Gamble Company, Cincinnati, OH (US)

( * ) Notice: Subject to any disclaimer, the term of this patent is extended or adjusted under 35 U.S.C. 154(b) by 224 days.

(21) Appl. No.: 12/899,729

(22) Filed: Oct. 7, 2010

(65) Prior Publication Data

US 2011/0083986 A1 Apr. 14, 2011

(30) Foreign Application Priority Data

Oct. 9, 2009 (EP) ..... 09172685

(51) Int. Cl.
*B65D 5/00* (2006.01)

(52) U.S. Cl.
USPC ..... 206/775; 206/736; 229/125.32; 220/666

(58) Field of Classification Search ..... 206/736, 206/499, 440, 751, 438, 775; 229/125.32, 229/915, 124, 101, 117.05; 220/666, 6, 720
See application file for complete search history.

(56) References Cited

U.S. PATENT DOCUMENTS 3,485,435 A * 12/1969 Densen et al. ..... 206/424
4,094,458 A * 6/1978 Nelson, Jr. ..... 229/117
4,427,108 A * 1/1984 Coles et al. ..... 206/526
4,437,569 A * 3/1984 Sorenson ..... 229/204
4,437,570 A * 3/1984 Sorenson ..... 229/204
4,635,795 A * 1/1987 DeFlander et al. ..... 206/526
4,871,067 A * 10/1989 Valenti ..... 206/427
5,372,299 A * 12/1994 Edgerton et al. ..... 229/120.18
5,474,230 A * 12/1995 Yotukura ..... 229/117.04
5,505,369 A 4/1996 Taliaferro
5,555,982 A * 9/1996 Kuhn et al. ..... 206/746
5,657,872 A * 8/1997 Leftwich et al. ..... 206/738
6,129,211 A * 10/2000 Prakken et al. ..... 206/750
6,394,336 B1 * 5/2002 Beneroff et al. ..... 229/101
6,974,033 B2 * 12/2005 McLeod et al. ..... 206/736
7,523,825 B2 * 4/2009 Velazquez et al. ..... 206/440
2009/0272790 A1 * 11/2009 Weissbrod ..... 229/101
2012/0074016 A1 * 3/2012 Gelardi et al. ..... 206/459.5

OTHER PUBLICATIONS

PCT International Search Report, mailed Dec. 28, 2010, 4 pages.

* cited by examiner

*Primary Examiner* — Steven A. Reynolds
(74) *Attorney, Agent, or Firm* — Andres E. Velarde; Brian M. Bolam

(57) ABSTRACT

A package (10) comprising a tray component (20) and a hood component (30) containing a plurality of products (40). The tray component comprises a bottom panel (21) and at least two opposed outer side panels (22, 23). The hood component (30) is placed within the tray component (20), comprises a top panel (31) and at least two inner side panels (32, 33), wherein said two inner side panels placed respectively in face to face relation with said two outer side panels of said tray component. When no load is applied on the top panel, a gap (G) separates the products from the top panel, and when a load of 1.50 N/cm$^2$ is applied uniformly on the top panel (31), the inner side panels (32, 33) bend inwardly towards the products (40), so that the inner side panels come in contact with the products without the top panel coming in contact with the products. The products (40) are sufficiently rigid so that they can stop or limit the inner panels (32, 33) from further bending when the inner panels (32, 33) come in contact with the products (40). The package provides improved resistance to vertical load and/or material saving.

20 Claims, 6 Drawing Sheets

TRAY AND HOOD PACKAGE

FIELD OF THE INVENTION

The present invention is in the field of packaging. In particular, the present invention relates to a package that can be used to transport and display consumer products, and comprising a tray component and a hood component. The tray component containing the products can be placed on a supermarket shelf while the hood component, which primarily serves to protect the products during storage and transport, can be removed before placing the products on display at the point of sale.

BACKGROUND OF THE INVENTION

Manufactured products are increasingly packaged in shelf ready packaging, which allows the supermarket staff to install several products in one movement instead of having to place each article on the shelf separately. Various types of shelf ready packages have been proposed in the past. A basic solution is for example a simple tray made of corrugated cardboard, where the products are simply placed on the tray. However this solution is only suitable for compact and pressure resistant goods because it is normally necessary to stack several trays filled with products on top of each other during storage and transport to form a pallet. Since it is usually a practical requirement that at least two pallets can be stacked on top of each other, the products at the bottom of the stack may be subject to a relatively high load. Furthermore, with such a simple tray construction, dirt may soil the products or the products may be easily damaged during transport and storage.

Closed and semi-closed corrugated boxes have been used for more fragile products or to avoid soiling of the products during storage and transport. To allow quick placement of the products on the shelf by the supermarket staff, it is desirable that these boxes can be placed directly on the shelf after being opened to allow the buyers to take the products out. Corrugated boxes having a perforated line so that the top part of the box can be separated by tearing it off from the bottom part have been proposed. However tearing off the top part can be difficult and often leaves an unaesthetic rough edge to the bottom part of the box which stays on the shelf.

So called "tray and hood" packages have been proposed wherein a hood component is placed within a tray component. The hood component may be releasably attached to the tray component. EP1,864,913 discloses a tray and hood package with an opening in the top panel. U.S. Pat. No. 5,447,225 discloses a collapsible "tray and shroud" construction for easy transport and disposal. Other tray and hood packages have been proposed in the patent literature, for example see CH652096, EP571,711, U.S. Pat. No. 5,632,439 or U.S. Pat. No. 6,386,366.

Tray and hood packages are normally stacked to form easily transportable pallets, which can in turn be stacked on top of each other. Thus a relatively high load can be exerted on the boxes placed at the bottom of the stacks. This vertical load is either carried by the package itself, which has the inconvenience of necessitating relatively thick and strong cardboard material, which is expensive and wasteful, or by the products within the packages if the products are in load carrying contact with the top of the box, which is only suitable for compression resistant products that do not risk being damaged by a vertical load.

There remains a need for a convenient packaging for the transport and display of products, which uses less packaging material than previous solution and which can be used to transport products relatively sensitive to a vertical load.

SUMMARY OF THE INVENTION

The inventors have surprisingly found that the above problems could be solved by a package according to the claims. The package of the invention comprises a tray component and a hood component, the hood component being releasably placed within the tray component, and a plurality of products contained in the package. The tray component comprises a bottom panel and at least two outer side panels. The hood component comprises a top panel and at least two inner side panels, wherein the two inner side panels of the hood component are placed respectively in face to face relation with the two outer side panels of the tray component. The products are separated from the top panel by a gap when no load is applied to the top panel.

When a load of 0.8 $N/cm^2$ is uniformly placed on the top panel, the inner side panels bend inwardly so that the inner side panels come in contact with the products. The top panel however does not come in load bearing contact with the products. The products are sufficiently rigid so that they can stop or limit the inner walls from further bending when the inner walls come in contact with the products.

Thanks to this surprising stabilizing effect provided by the interaction of the inner walls, outer walls and the products contained in the package of the invention, the tray and hood components of the package can be made of less material, thus providing a saving in material usage compared to previously thought.

DETAILED DESCRIPTION OF THE INVENTION

While the specification concludes with claims which particularly point out and distinctly claim the invention, it is believed the present invention will be better understood from the following description of preferred embodiments taken in conjunction with the accompanying drawings.

Figure 1:
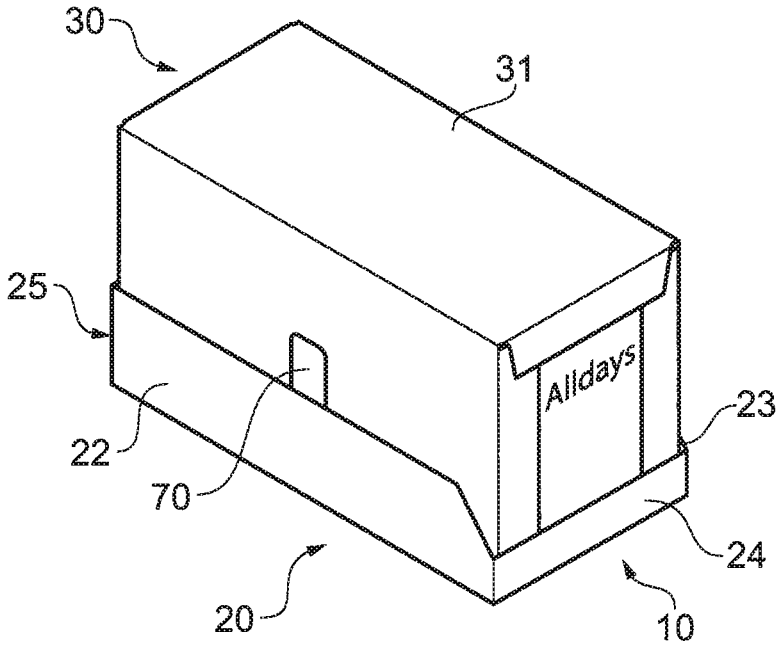
FIG. 1 is a perspective view of an embodiment of the package of present invention.

FIG. 1 shows a perspective view of an exemplary package 10 according to the invention. The package comprises a tray component 20 and a hood component 30. The package contains a plurality of products 40, in this example a plurality of carton boxes. The hood component 30 is placed within the tray component 20, and can be released from the tray component as shown on FIG. 2. The package may be of a generally cuboid shape, as is usually the case in the field of packaging, being elongated in one direction, this long side being usually intended to be placed in the direction of the depth of the supermarket shelf. The products 40 may form a stack, which is orientated in the same direction as the long side of the package 10.

The tray component 20 comprises a bottom panel 21 and at least two opposed outer side panels 22, 23. The indication "outer" herein indicates that these panels are placed more outwardly than the hood, the hood being placed inside the tray. By "opposed" it is meant that the panels are placed in parallel planes but on opposed sides of the package.

The term "panel" as used herein refers to the packaging material present on a side of the tray component or hood component, in the horizontal plane (bottom panel, top panel) or in the vertical plane (side panels, front and back panels). The front panel can be defined as the panel which is on the side of the package that is intended to be presented to the consumer, i.e. where the front of the products is visible. The back panel is on the side opposed to the front panel. The top panel and the bottom panel are in the horizontal plane, on opposed sides of the package. The side panels are on the lateral sides of the package.

As will be discussed below, each panel may be made of a single piece of material or may be made from several pieces of materials, which may be attached (e.g. glued) together or not. Each panel may comprise one or more opening or may be full.

The products 40 are placed on the bottom panel 21 of the tray component 20. The tray component is intended to be placed on the shelf at the point of sale with the products placed therein. Thus, the supermarket staff can place the plurality of the products on the shelf in one movement and does not have to manipulate the individual products. The two opposed outer side panels 22, 23 of the tray component 20 maintain the products within the tray when placed on the supermarket shelf. During transport and storage, they also help stabilizing the package by contacting the inner side panels 32, 33 of the hood component.

The tray component 20 may advantageously further comprise a front panel 24 and/or a back panel 25 to avoid the product falling off the tray in these directions when the hood is removed. The front panel 24 is the panel on the side of the tray that is intended to be presented to the buyer when the tray is placed on a shelf and it may advantageously be of smaller height than the side panels and/or back panel to allow easier removal of the product.

Figure 3:
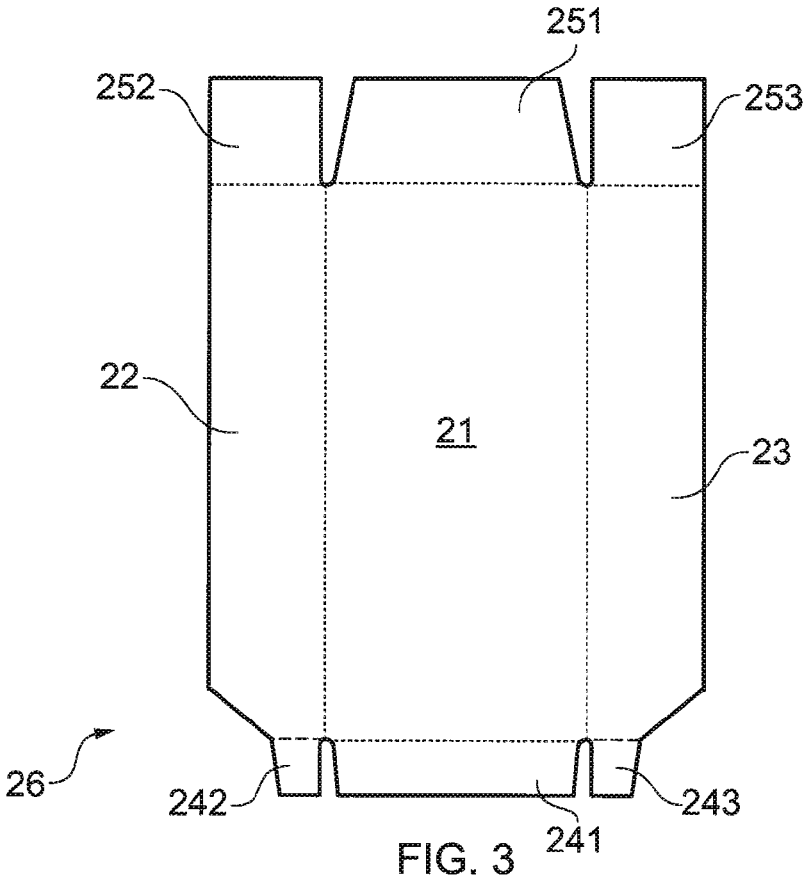
FIG. 3 is a top view of a carton blank for the tray component.
Figure 4:
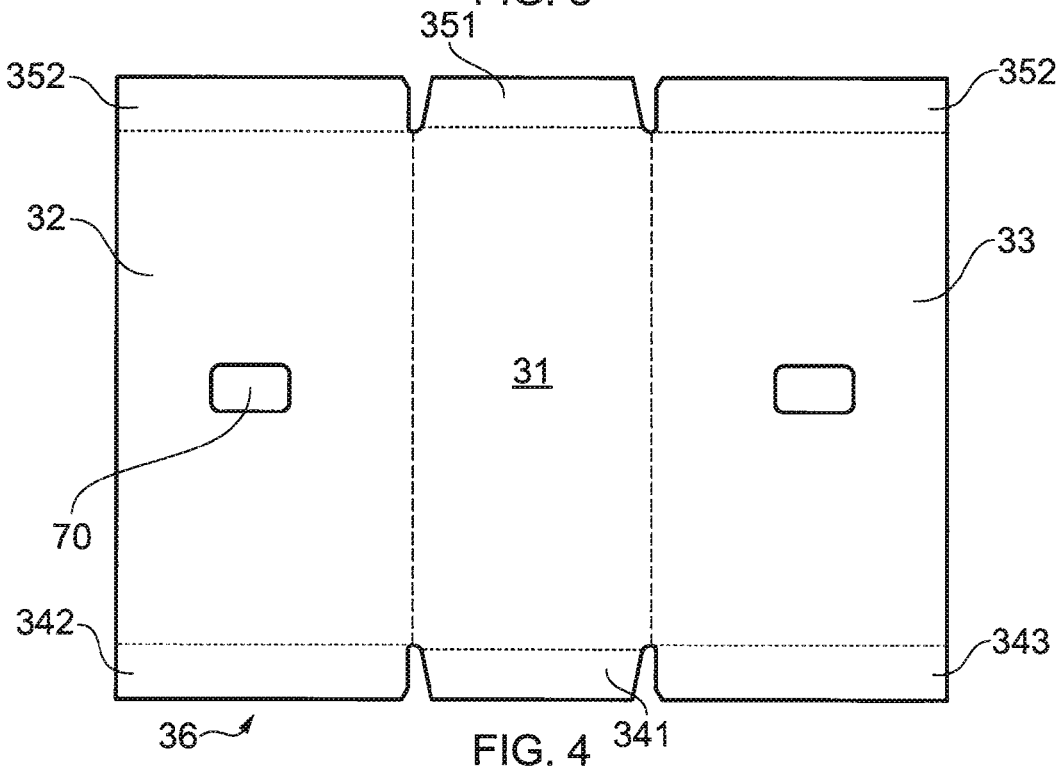
FIG. 4 is a top view of a carton blank for the hood component.

The opposed outer side panels 22, 23, and the front and back panels 24, 25 if present, are advantageously made of the same material as the bottom panel 21 and may be formed from a flat blank 26 cut from a piece of suitable material such a corrugated cardboard as is well known in the art. The blank 26 may comprise the bottom panel 21 from which extend the other panels in a flat shape and that can be folded at a 90 degrees angle respective to the bottom panel to form the tray. An example of such a blank is shown on FIG. 3, where each of the side panel 22, 23 is as single piece of material extending from respective sides of the bottom panel 21, and wherein the front panel 24 is formed by gluing together a front piece of material 241 extending from the front side of the bottom panel 21 with two side extensions 242, 243 of the side panels 22, 23. The back panel 25 is similarly formed by gluing a piece of material 251 extending from the back side of the bottom panel with two side extensions 252, 253 of the side panels 22, 23. In this exemplary embodiment, the side panels 22, 23 are made of a single piece of material and the front and back panels 24, 25 are made of three pieces of material 241, 242, 243, 251, 252, 253 each which can be glued together to provide more rigidity to the tray component.

Since the tray component is intended to be placed on the shelf, it may be advantageously printed or otherwise decorated, in particular the front panel 24 of the tray may display information about the products and/or decorative features.

The hood component 30 comprises a top panel 31 and at least two opposed inner side panels 32, 33. The two inner side panels are placed in face to face relationship with the two outer side panels 22, 23 of the tray component 20. The term "inner" is used herein to indicate the respective position of the side panels of the tray and of the hood in relation to each other. The inner side panels 32, 33 are placed inwardly of the outer side panels 22, 23 since the hood is placed within the tray 20, however it is clear that the part of the inner side panels of the tray placed above the outer side panels of the hood form the outer surface of the package.

Figure 2:
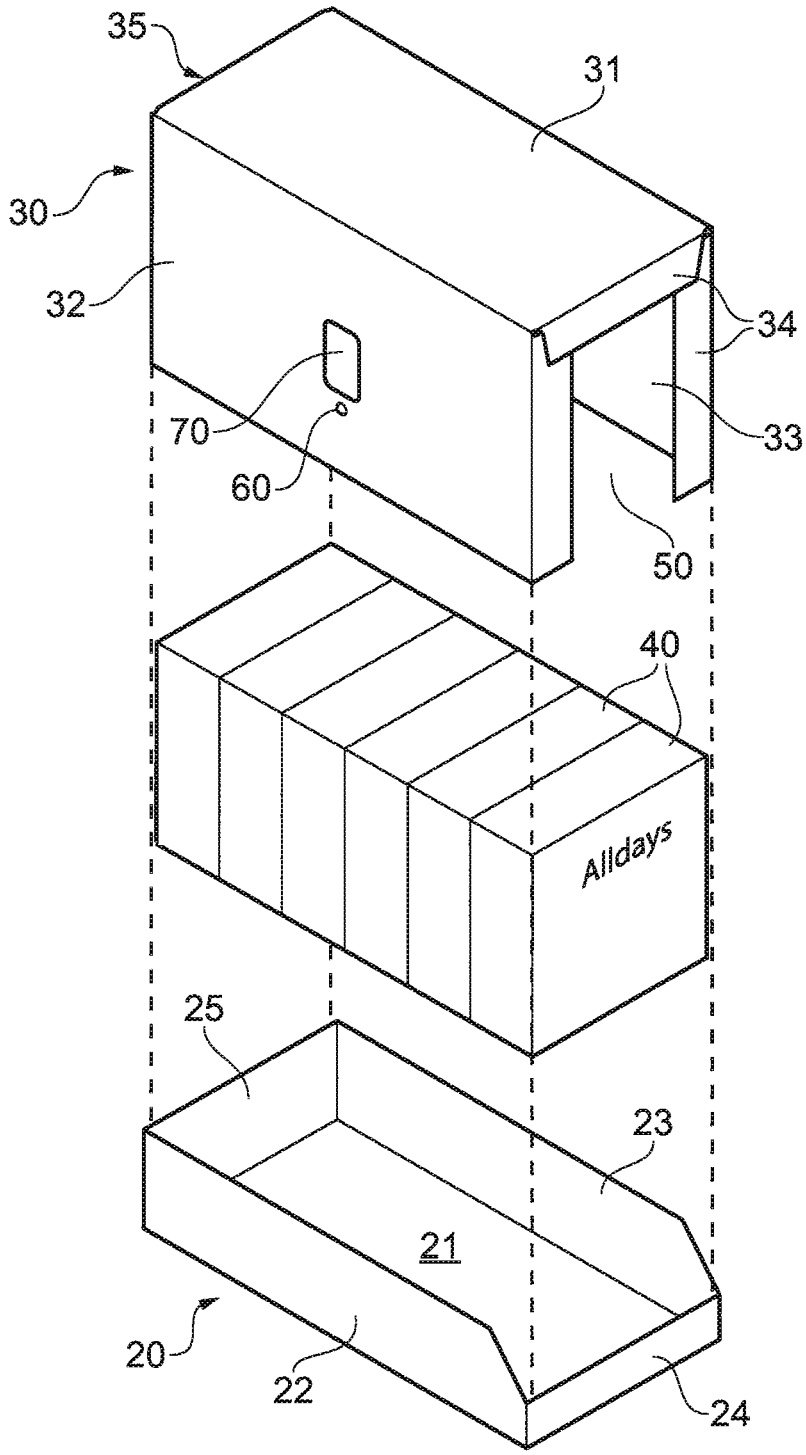
FIG. 2 is a perspective view of the embodiment of FIG. 1 with the hood component separated from the hood component.

As for the tray component, the hood component may be made from a flat blank 36 comprising the top panel 31 and side extensions 32, 33, 341, 342, 343, 351, 352, 353 which are then folded to form the outer side panels 32, 33 and optionally a hood front panel and back panel 34, 35. As for the tray component, part of these side extensions 341, 341, 343, 351, 352, 353, can be glued together to form a panel and provide more rigidity to the hood. The front and/or back panels of the hood, if present, may advantageously present a relative large opening 50 as shown in FIG. 2 to save material and provide a window-like opening that allow the supermarket staff to see what products is placed within the package.

The tray component 20 and the hood component 30 may advantageously be releasably attached together. For example one or more glue spots 60 may be placed between each of the inner and outer side panels. The supermarket staff can then separate the glued side panels by pushing the side panels apart. As shown in FIGS. 1-2, a side opening 70 may be placed in the inner side panel above the glue spot(s) to allow the supermarket attendant to more easily pull outwardly on the outer side panel to break the glue seal. In other embodiments, it may not be necessary to attach via glue spots or other attachment means the tray component and the hood component, in particular if these are relatively tightly fitted around the products.

As indicated in the background section of the invention, tray and hood packages have been made in the past using relatively strong and thick cardboard material to provide the package with resistance to vertical load, as in many applications it is not wished that the products contained in the package be subject to vertical compression load. The inventors have made the surprising discovery that the amount of material used could be reduced by using a stabilizing effect provided by the interaction of the side walls with the products. This effect is illustrated on FIG. 6-7, which are cross-section schematic views of the package in the vertical plane perpendicular to the side panels.

Figure 5:
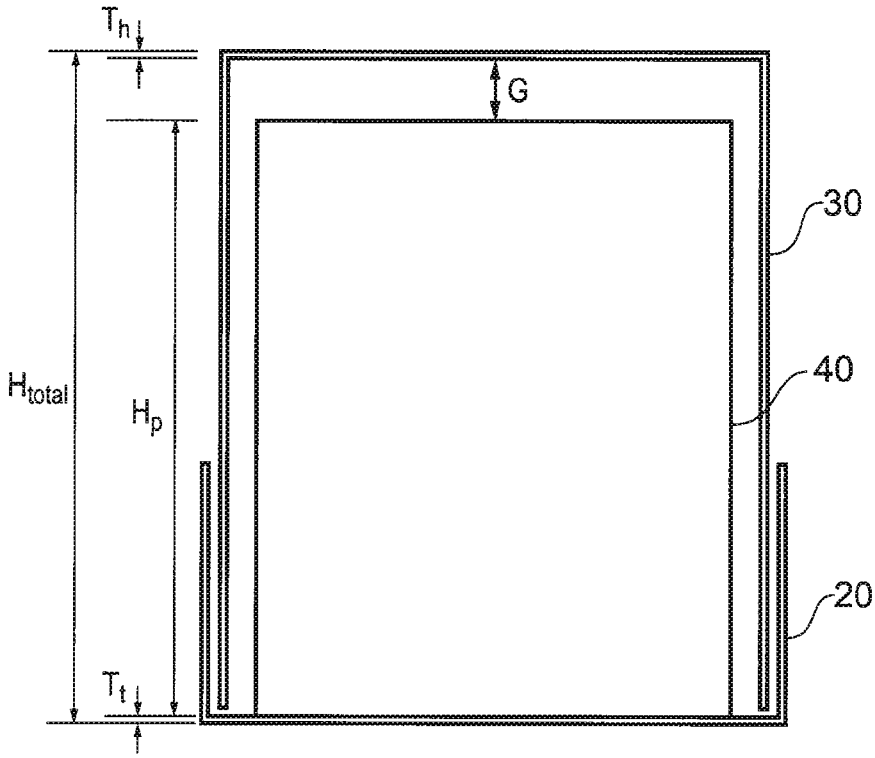
FIG. 5 is a cross-section schematic view of the package with no load applied.

As shown in FIG. 5, the package is made so that a gap G separates the products from the top panel of the hood component when no vertical load is applied to the top panel. The gap may be of at least about 2 mm, or more, such as at least about 3 mm, at least about 4 mm or at least about 5 mm. Bigger gaps may be used, but then the package become unnecessarily bulky, so that a gap ranging between about 2 mm and about 1 cm may be considered as generally suitable. The gap provides for that there is no load bearing direct contact between the top panel and the products, so that the load cannot be transferred directly from top panel to the products.

In practice, the gap may be difficult to measure in the finished product, as the tray component will cover the products, and also because the top of the products may not be completely flat, in particular if the products are packaged in a plastic wrap such as flow wrap for example. The size of the gap may however be accurately determined indirectly by measuring separately the total height of the package (Htotal), the height of the products (Hp) and the thickness of the material used for tray component (Tt) and the hood component (Th) (in most cases Tt=Th because the same material would be used to make the tray and the hood) and applying the following formula:

$$G=H\text{total}-Hp-Tt-Th$$

Of course the height and thickness measurements should be made on products in good conditions, such as coming out from the production line, without any visible deformation due to previous compression.

The height Htotal and Hp can be measured using a standard method in the field of packaging using a slideable circular foot and a base plate. The equipment may comprise an apparatus capable of measuring the height Htotal and Hp with at least a 0.3 mm tolerance. A commercial supplier of such equipment is for example Alluris (www.alluris.de), for example their universal packaging tester FMT 310 fitted with a digital readout. A generally suitable foot size is a circular foot of 15 cm diameter.

The apparatus can be set to measure the height of the articles at a given force. A force sufficient to flatten any small irregularities, for example any free material extending from a fold in the flow wrap around the products, but not so strong as to deform the articles should be used. A force of 1 N is generally used.

The test procedure is as follows: zero (calibrate) the apparatus. Place the article to be measured (i.e. the tray and hood package or the product) on the base plate so that the top of the article is facing up. Position the article on the base plate so that when the foot is lowered, the foot center is centered on article. Let the foot gently lowers itself onto the article at a rate of 180 mm/mn+/−5 mm/mn until it is in contact with the article with the defined force (1N). The article height is indicated on the digital read-out after the foot comes to rest. Of course, if the products are stacked on two or more layers as exemplarily shown in FIG. 9, the height Hp will be twice (or more) the height of the individual product measured.

The thickness of the tray material Tt and hood material Th are much smaller than the height of the package so that a different apparatus may be used to measure them. These materials being not very compressible, a manual measurement gives suitable results, for example a manual micrometer may be used. An automatic micrometer with a slideable foot and digital recording and display may be also used, using the same principle as indicated above, for example a Ono Sokki (www.onosokki.net) apparatus such as the Caliper Gauge GS.503 with a foot having a diameter of 24 mm at a force of 1 N. In general, the thickness(es) for the tray material and the hood material is also provided by the supplier so that a direct of these measurement is not necessary.

Figure 6:
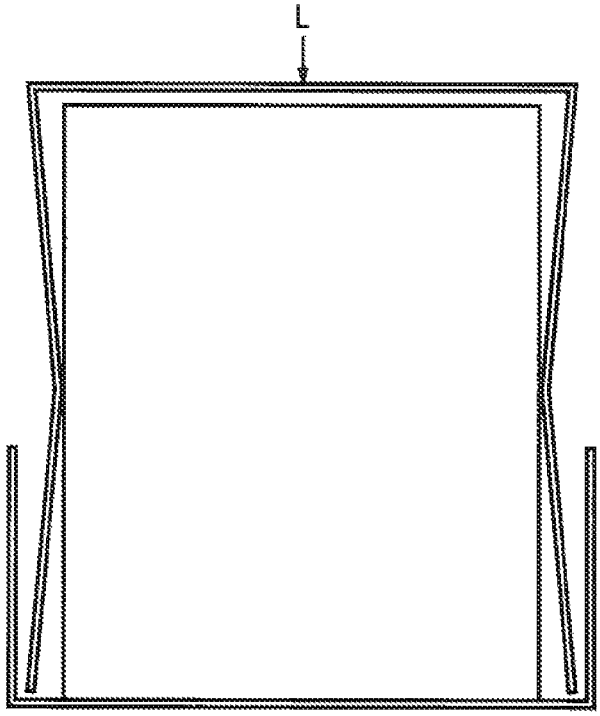
FIG. 6 is a cross-section schematic view of the package with a sufficient load applied so that the inner side walls start bending and contact the products.

Turning back to the schematic drawings of FIG. 5 and FIG. 6, FIG. 6 shows the package submitted to a vertical load uniform across the top panel, as would be typically encountered by the package at the bottom of a pallet. As schematically shown in the FIGS. 5-6, because of the initial-gap G between the top panel and the products, the top panel does not come in contact with the products even under compression. Rather, the inventors have surprisingly found the load placed on the top panel forces the inner side panels of the hood to bend inwardly so that the inner side panels come in contact with the products. The products are sufficiently rigid in the direction perpendicular to the side panels so that they provide a resistance to further bending of the inner side walls. This resistance stops or limits the inner walls from further bending when the inner walls come in contact with the products and provide stability. In this schematic diagram, the tray is shown not attached to the hood, but if the tray was releasably attached to the hood by a glue spot for example, it is expected that the outer side panels of the tray will follow the bending of the tray.

Figure 7:
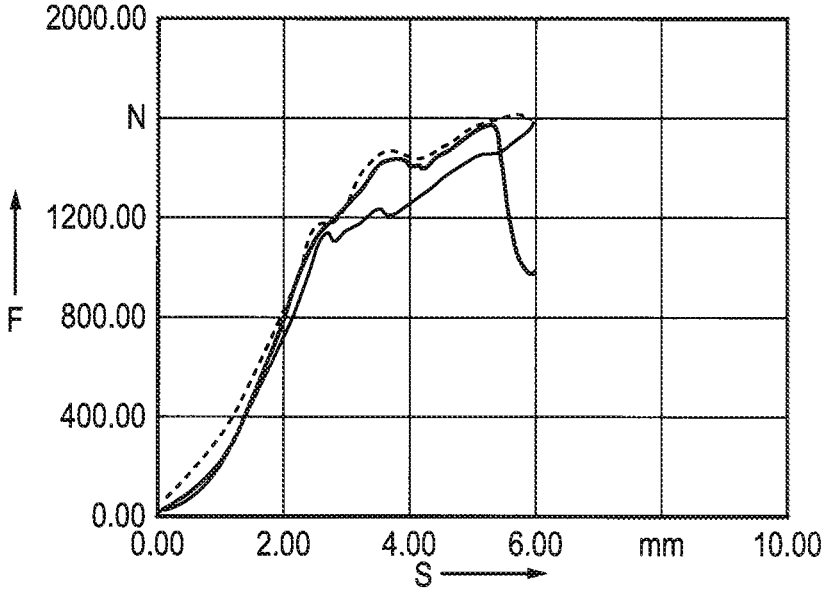
FIG. 7 and FIG. 8 show the compression profile of an exemplary package such as shown on FIG. 1 with and without products placed therein.
Figure 8:
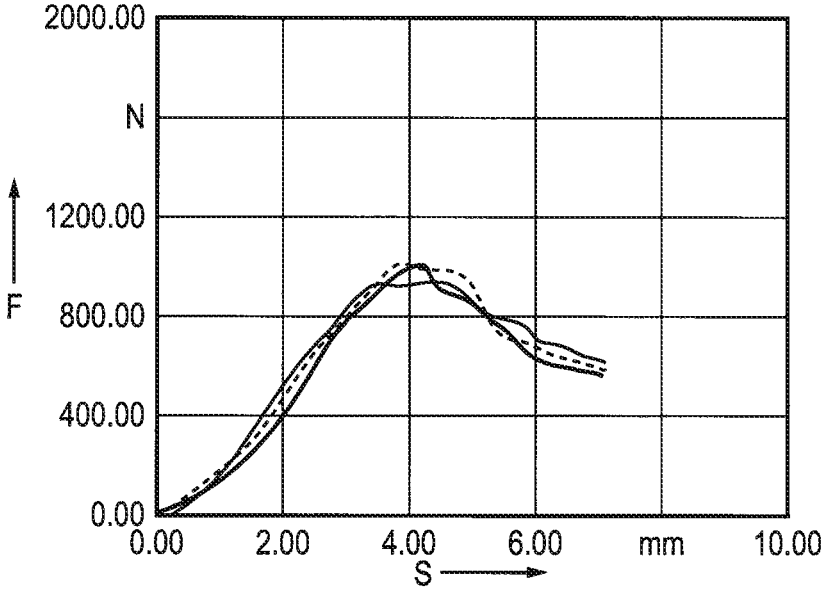

The stabilizing effect provided by the interaction of the side walls and the products is demonstrated in the compression profiles shown FIGS. 7 and 8 (such compression profile can be made using standard methods, for example, test method T804 om-89 from TAPPI). In these tests, the package is placed between two flat platens, one of which is mechanically or hydraulically driven to compress the package. A recording device is incorporated to indicate the force and deformation required to compress the container.

FIG. 7 shows a compression profile of an exemplary package as shown on FIG. 1, the products being carton boxes containing feminine care articles. In this example, the top panel has a width of 15.2 cm and a length of 33 cm. The gap G was about 4 mm. FIG. 8 shows a compression profile of the same package but without the products. The inventors surprisingly found that the filled package provides a much higher load resistance before collapsing compared to the unfilled pack, even when the displacement was smaller than the gap G. For example, the force necessary to displace the top panel downwards by 2 mm (for this filled package corresponding to a load of about 1.5 N/cm$^2$ uniformly applied on the top panel) with the filled package was double the force necessary with the empty package (the starting gap G being about 4 mm, this effect cannot be due to the interaction of the top panel with products).

The inventors believe that when a sufficient load is applied uniformly on the top panel, the inner side panels start bending inwardly towards the products, so that the inner side panels come in contact with the products without the top panel coming in contact with the products. The products should be packed sufficiently tightly with the inner sides of the hood (e.g. with a gap on each side of less than 1 mm) so that this effect can take place at moderate load, in particular when a uniform load of 1.50 N/cm$^2$ is applied. In some embodiments, the package can sustain a load of at least 2 N/cm$^2$ applied uniformly on the top panel 31 without the top panel coming in contact with the products 40.

If the lateral gaps between the inner panels and the products are too large, the inner wall when bending may not contact the products and this stabilizing effect may be lost. Because of the stabilizing effect of the invention, lower grammage material may be used than what would have been expected, for example for absorbent products (which are relatively bulky but light material) the basis weight of the material used for the tray component and hood component may be of from 240 to 700 gsm, or lower such as 240 to 500 gsm. The material may advantageously be corrugated cardboard, but other materials such as full cardboard or plastic may also be used. The material for tray component may be the same material that is used for the hood component. The package used in the measurement of FIG. 7 and FIG. 8 was a corrugated cardboard of 390 gsm (of course taking into account all the layers, inner and outer, of the corrugate).

The products contained in the package should be sufficiently rigid in the direction perpendicular to the side walls so that they can stop or limit the inner walls from further bending when the inner walls come in contact with the products. The products may be for example carton boxes used as primary packaging for consumer good products such as washing powder, disposable absorbent products (e.g. feminine hygiene articles), food products such as cereals, etc. . . . .

Carton box products containing relatively fragile goods such as foodstuff and disposable absorbent products are advantageous used in the present inventions because their front and back panels (orientated in the same direction as the front and back panels of the package) stand perpendicular to the inner walls of the package and can provide the required resistance to the bending of the inner walls.

Figure 9:
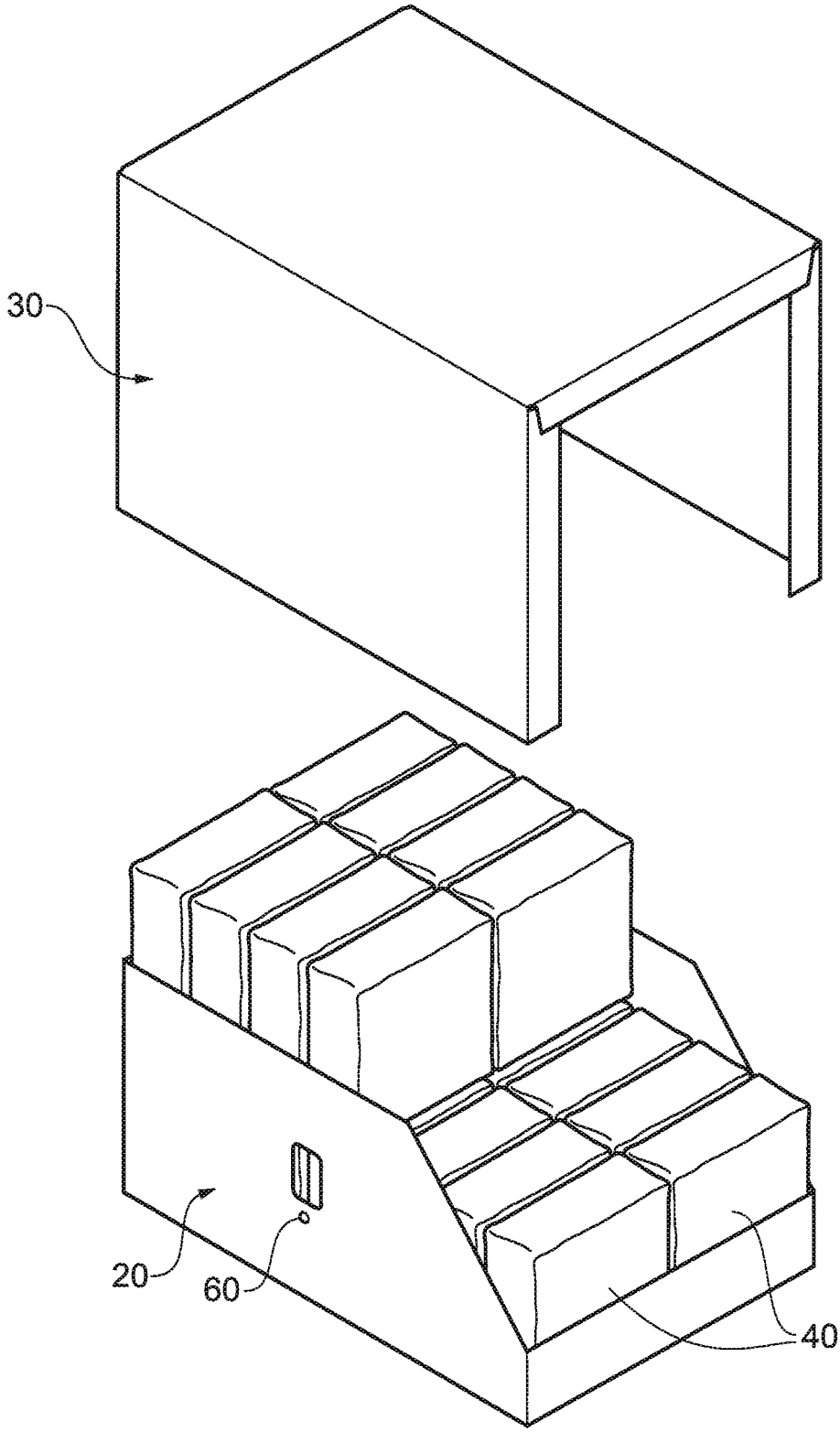
FIG. 9 shows another embodiment of the invention.

FIG. 9 shows an alternate embodiment of the invention wherein two rows of products are stacked as two layers in the tray. The products, as represented in FIG. 9, may also be soft bags containing absorbent products. In this embodiment, it may be beneficial that the absorbent products are placed so that they can provide resistance to the bending of the side walls. Normally, these products are packaged in the primary packs in a folded configuration, so that orientating these fold lines perpendicular to the inner walls will provide the most resistance.

The package may be assembled using conventional technique. The following sequences may be used. The hood component is placed in the bucket chain with the side panels (and front and back panels if present) erected to a V-shape (half open). The products are then placed in the hood component. The side panels are erected to 90 degrees. The pieces forming the front and back panels are folded and glued. The flat tray blank is placed on top of the hood component (filled with the products), and finally the tray component is folded and glued by pushing through a form funnel (tray panel gluing+tray to hood gluing).

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A package containing a plurality of products, the package comprising a tray component and a hood component, the hood component being placed in contact with the tray component, wherein:

the tray component comprises a bottom panel;

the hood component comprises a top panel and at least two inner side panels, wherein:

when no load is applied on the top panel, a gap separates the products from the top panel, and when a load of about 1.50 N/cm$^2$ is applied uniformly on the top panel, the inner side panels bend inwardly towards the products, so that the inner side panels come in contact with the products without the top panel coming in contact with the products.

2. A package according to claim 1 wherein the package can sustain a load of at least about 2 N/cm$^2$ applied uniformly on the top panel without the top panel touching the products.

3. A package according to claim 1 wherein the products comprise primary packages in form of carton boxes or soft bags.

4. A package according to claim 3 wherein the primary packages form one or more stacks orientated perpendicularly to the inner side walls of the package.

5. A package according to claim 1 wherein the tray component and/or the hood component are made of a material comprising corrugated cardboard.

6. A package according to claim 5 wherein the corrugated cardboard has a basis weight of between about 240 and about 700 gsm.

7. A package according to claim 6 wherein the corrugated cardboard has a basis weight of between about 240 and about 500 gsm.

8. A package according to claim 1 wherein the tray component further comprises a front panel and rear panel.

9. A package according to claim 8 wherein the height of the front panel of the tray component is lower than the height of the rear panel of the tray component.

10. A package according to claim 1 wherein the hood component further comprises a front panel and a rear panel.

11. A packaging according to claim 10 wherein the front panel and the rear panel are formed from side flaps extending from the top panel and the inner side panels.

12. A package according to claim 11 wherein the hood front panel and/or the hood rear panel comprises an opening through which at least one of the product can be identified.

13. A package according to claim 1 wherein the hood component is releasably attached to the tray component.

14. A package according to claim 13 wherein the tray component comprises two outer side panels and wherein the inner side panels and the outer side panels are attached to each other by adhesive.

15. A package according to claim 14 wherein at least one of the inner side panels comprises an opening which overlaps a top edge of the corresponding outer side panels.

16. A package according to claim 15 wherein the inner side panels comprise glue spots and wherein the opening in the inner side panel(s) is or are placed above at least one of the glue spots.

17. A package according to claim 1 wherein the products comprise disposable absorbent products.

18. A package according to claim 17 wherein the disposable absorbent products are feminine hygiene articles.

19. A packaging according to claim 18 wherein the feminine hygiene articles are packaged in primary packages.

20. A package containing a plurality of products, the package comprising a tray component and a hood component, the hood component being placed releasably attached in contact with the tray component, wherein:

the tray component comprises a bottom panel and two outer side panels;

the hood component comprises a top panel and at least two inner side panels, wherein:

each inner side panel is located between the product and a respective outer side panel, when no load is applied on the top panel, a gap separates the products from the top panel, and when a load of about 1.50 $N/cm^2$ is applied uniformly on the top panel, the inner side panels bend inwardly towards the products such that the bend in each inner side panel contacts the products at the furthest lateral distance from the respective outer side panel without the top panel coming in contact with the products.

* * * * *